US008287399B2

(12) United States Patent
LaCombe

(10) Patent No.: US 8,287,399 B2
(45) Date of Patent: Oct. 16, 2012

(54) GOLF CLUB CADDY

(76) Inventor: John LaCombe, Northridge, CA (US)

( * ) Notice: Subject to any disclaimer, the term of this patent is extended or adjusted under 35 U.S.C. 154(b) by 275 days.

(21) Appl. No.: 12/881,931

(22) Filed: Sep. 14, 2010

(65) Prior Publication Data

US 2012/0064989 A1 Mar. 15, 2012

(51) Int. Cl.
*A63B 55/00* (2006.01)

(52) U.S. Cl. ..... 473/282; 206/315.2; 211/70.2

(58) Field of Classification Search ..... 473/282; 206/315.2; 211/70.2; D21/796; D6/552
See application file for complete search history.

(56) References Cited

U.S. PATENT DOCUMENTS

| | | | | |
|---|---|---|---|---|
| 2,791,255 | A * | 5/1957 | Ogden | 294/143 |
| 4,669,726 | A * | 6/1987 | Lempio | 473/299 |
| 5,413,329 | A * | 5/1995 | Hirsch | 473/238 |
| 5,492,384 | A * | 2/1996 | Tarko et al. | 294/143 |
| 5,669,514 | A * | 9/1997 | Massetti | 211/70.2 |
| 6,830,519 | B2 * | 12/2004 | Reed et al. | 473/290 |
| 7,611,421 | B2 * | 11/2009 | Brewer et al. | 473/282 |
| 2006/0163893 | A1 * | 7/2006 | Gascoigne | 294/143 |
| 2012/0061270 | A1 * | 3/2012 | LaCombe | 206/315.2 |

FOREIGN PATENT DOCUMENTS

DE 199 00 252 C1 * 1/2000

* cited by examiner

*Primary Examiner* — Stephen L. Blau
(74) *Attorney, Agent, or Firm* — James A. Italia; Italia IP

(57) ABSTRACT

A holder for holding a limited number of golf clubs, less than a full standard set of clubs, in an organized way. The holder may comprise three manually assembled snap fit components including two end plates and a central shaft which spans and connects the two end plates. Each end plate may be identical to the other, having a plurality of recesses located about its periphery, for receiving the shafts of golf clubs in releasable snap fit fashion. The end plates and their recesses are arranged so that the golf clubs are held parallel to one another and to the central shaft of the holder. The central shaft may be contoured to include finger grips for example, thereby serving as a handle for grasping the holder both alone and also with golf clubs retained thereon.

19 Claims, 3 Drawing Sheets

GOLF CLUB CADDY

FIELD OF THE INVENTION

The present invention relates to golf equipment, and more particularly to a carrier for carrying golf clubs in parallel, spaced apart orientation.

BACKGROUND OF THE INVENTION

Golfers must carry golf clubs about when playing golf. This holds true not only on a golf course, but also in transit to golf courses. Golf clubs are somewhat lengthy and heavy. While no one single golf club is unduly lengthy or heavy, a complete set of golf clubs becomes somewhat onerous to transport. Golf clubs are typically carried about and stored in golf club bags designed for that purpose. Because such bags are frequently used to carry additional articles, such as other golf accessories, refreshments, and the like, golfers must frequently call on caddies to bear the burden, to use motorized golf carts to bear the burden, or be subjected to the tiring effort of carrying a golf bag oneself. Resulting fatigue and body heating can impair golf performance and otherwise detract from the golf experience.

Most golfers engage in practice sessions, particularly to address those aspects of their game which are at a level of accomplishment less than others. When a golfer wants to engage in a practice session for a particular type of swing or stroke, it is not necessary to bring a full set of golf clubs to a golf course. It may be necessary or desirable to bring a limited number of clubs but more than just one.

Using a golf bag in this situation leads to one of several undesirable situations. One is obviously, to carry about the unnecessary clubs. Another is to leave behind those clubs deemed unnecessary. The latter situation entails undesirable consequences. For one thing, in ordinary life, leaving golf clubs behind singly, even in a group, risks misplacement or loss of one or more clubs, and furthermore leaves these clubs unprotected from environmental hazards such as being exposed to dirt and impacts with household or other objects which may be placed in proximity to the left behind clubs, or even piled onto the left behind clubs. Even where there is no hazard to the clubs themselves, leaving some of them behind in a home environment may cause inconvenience to others. A pile of golf clubs outside an apparatus which holds them in a compact or organized way may easily obstruct passage or other activities in an occupied building.

Bringing a limited number of individual golf clubs to a practice session is not only unwieldy, but also risks inadvertently leaving perhaps one golf club behind, thereby losing it.

It would be a convenience to have a way of organizing a limited set of golf clubs for limited play, such as practice sessions which call on only that limited set of clubs.

SUMMARY OF THE INVENTION

The present invention provides a compact, practical holder for a limited set of golf clubs. The holder is adapted to secure golf clubs in parallel, proximate yet spaced apart orientation. By holding the clubs in spaced apart orientation, the clubs are prevented from contacting one another, which could potentially scratch or dent metallic surfaces or even bend the handles, as well as preventing annoying noise from the clubs banging against one another, which could easily occur in a motor vehicle during transport.

To these ends, the novel holder comprises two opposed end plates each provided with recesses located at their respective outer circumferences. Each recess is adapted to receive and retain the shaft of a golf club handle by snap fit. The two opposed end plates are secured to one another by a removable central shaft which spans the two end plates and when assembled thereto, is oriented to lie along the respective centers of the two end plates. The two end plates are then held in longitudinal registry with one another so that when considered in end view, the recesses of one end plate overlie corresponding recesses of the other end plate. A golf club handle may then be snap fitted into two recesses and held parallel to the central shaft of the holder.

The end plates are dimensioned and configured to accommodate the enlarged head of each golf club such that the shafts of the handles of the golf clubs may remain parallel to one another.

The holder may be formed in three manually assembled and disassembled sections to facilitate ready assembly, yet to afford compact storage when not in use. When disassembled, the components of the holder may be stored in a standard golf club bag. The central shaft may snap fit to each of the two end plates, so that assembly and disassembly may be accomplished manually, without requiring tools.

In one aspect of the invention, each end plate is four sided, so that the holder can conveniently receive and retain up to four golf clubs. A psychological advantage of holding only a limited number of clubs is in certain situations, to discourage the golfer from selecting a club the use of which the golfer has mastered, so that the golfer is forced to use a club from the plurality of clubs which the golfer has not mastered, thereby forcing the golfer to gain experience which advances his or her play.

The central shaft of the holder, being located along the longitudinal center line of the holder, can be grasped as a handle to hold the holder by hand, even when golf clubs are carried on the holder.

The novel holder may be oriented either vertically in use or horizontally in use. That is, with three or more golf clubs retained thereon, the entire assembly may vertically supported on a floor or other horizontal surface with the several golf club heads resting on the floor or other horizontal surface. Or alternatively, the entire assembly may be inverted with the several ends of the golf club handles contacting the floor and with the heads of the golf clubs in the air.

According to a further aspect of the invention, the entire assembly may be placed lying on its side on the floor or other horizontal surface. The two end plates may be configured such that the golf clubs are held out of contact with the floor.

It is an object of the invention to provide a holder for holding a plurality of golf clubs but less than a full set of golf clubs.

Another object of the invention is to hold the plurality of golf clubs in a visually organized fashion.

A further object is to provide a golf club holder which is manually assembled and disassembled, thereby facilitating compact storage when not in use.

It is an object of the invention to provide improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein:

FIG. 2 is a perspective view of a plurality of golf clubs held by a holder such as the holder of FIG. 1, with the golf clubs lying parallel to a floor or the like.

DETAILED DESCRIPTION

Figure 2:
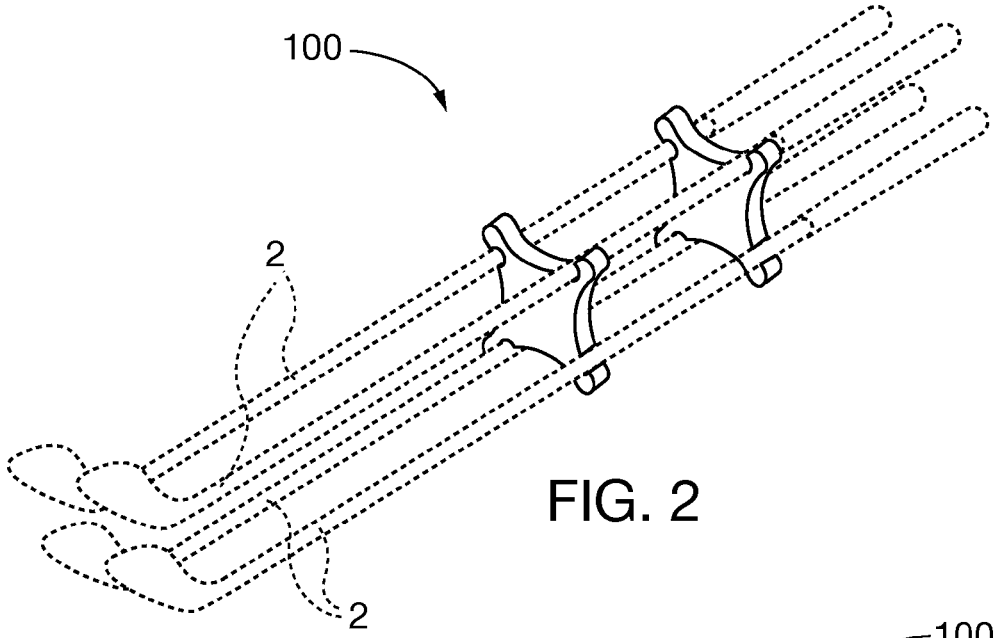
Figure 3:
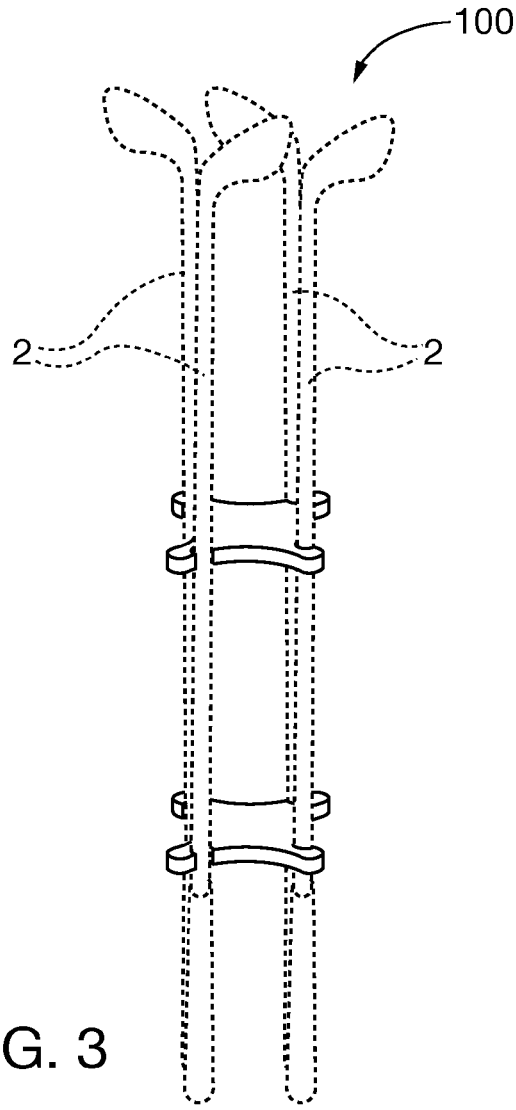
FIG. 3 is a perspective view similar to FIG. 2, but with the golf clubs in an erect posture standing upright.

Referring first to FIG. 2, a holder 100 is shown supporting a plurality of golf clubs 2 in a parallel array. In FIG. 2, the shafts of the golf clubs 2 are parallel to a horizontal surface such as a floor (not shown). FIG. 3 shows a similar array of golf clubs 2, but set upright on a horizontal surface such as the floor. It should be noted that orientational terms such as upright or lying on its side refer to the subject as drawn or as viewed by an observer. The drawing figures depict their subject matter in orientations of normal use, which could obviously change with changes in geometric position. Therefore, orientational terms must be understood to provide semantic basis for purposes of description, and do not limit the invention or its component parts in any particular way.

Figure 1:
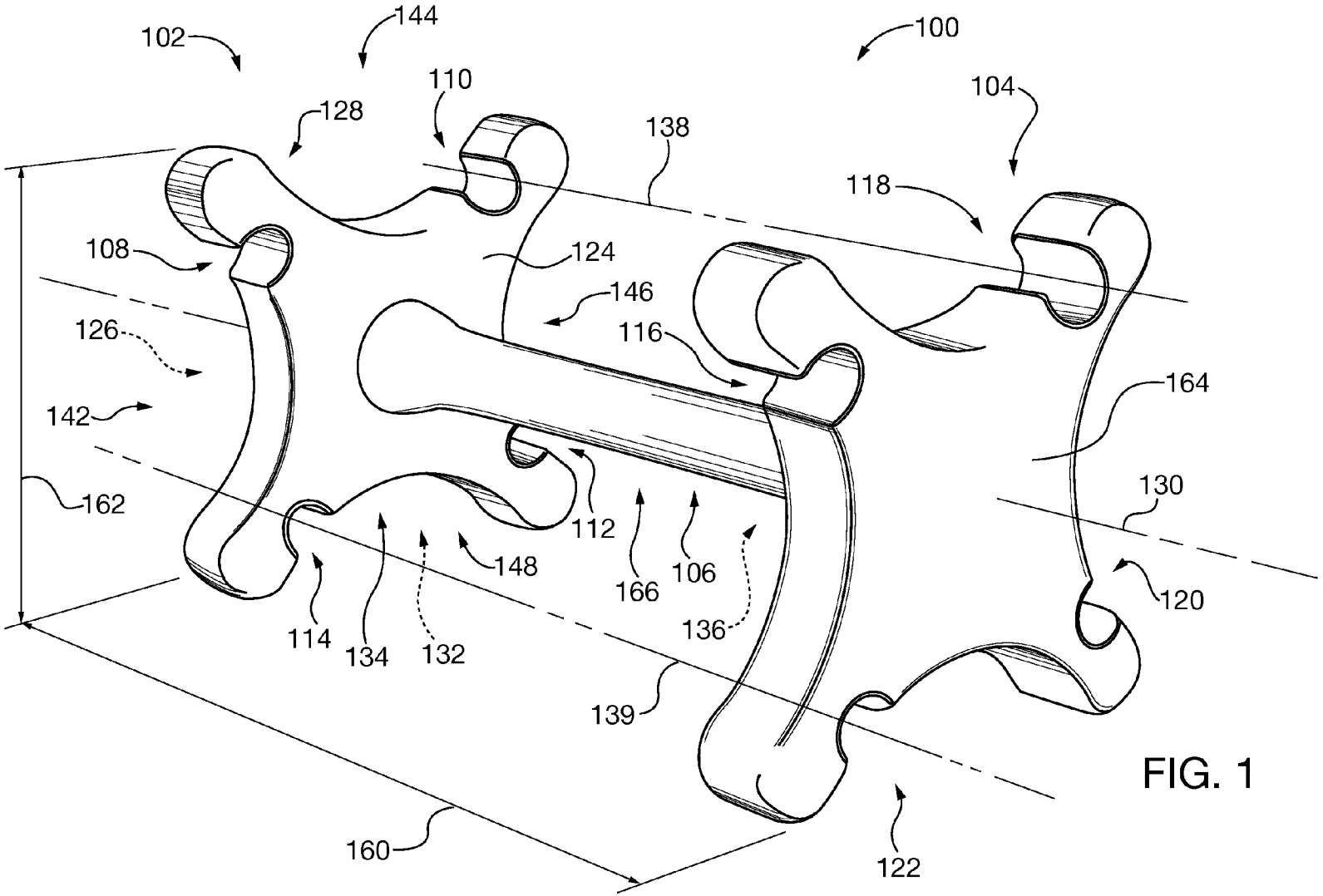
FIG. 1 is a perspective view of a holder for supporting a plurality of golf clubs according to at least one aspect of the invention.

FIG. 1 illustrates the nature of the holder 100, with the golf clubs 2 removed therefrom. The holder 100 may comprise three principal separate components, including a first end plate 102, an opposed second end plate 104, and a central shaft 106 which spans and connects the first end plate 102 to the second end plate 104. The first end plate 102 and the second end plate 104 may be similar in configuration but mirror image to one another. Both the first end plate 102 and the second end plate 104 have a plurality of notches or recesses 108, 110, 112, 114, 116, 118, 120, 122 formed therein. The purpose of the recesses 108, 110, 112, 114, 116, 118, 120, 122 is to receive and retain the shafts of the handles of the golf clubs 2, and to hold the golf clubs 2 with their respective handles generally parallel and spaced apart from one another as shown in FIGS. 1 and 2. Recesses 108, 110, 112, 114, 116, 118, 120, 122 may resiliently grip the shafts of the golf clubs 2 in a manner known as a snap fit for example.

Each end plate 102 or 104 has structural characteristics important to its function. Those characteristics will be pointed out with reference to the end plate 102, it being understood that the end plate 104 may be similar but in mirror image orientation.

The end plate 102 has an internally facing surface 124, an opposed externally facing surface 126, and a periphery 128 comprising that surface which spans the internally facing surface 124 and the opposed externally facing surface 126. The recesses 108, 110, 112, 114 are formed in the periphery 128 and are spaced angularly about the center of the end plate 102. The center of the end plate 102 is that portion of the end plate 102 through which a longitudinal center line 130 of the holder 100 passes. A blind hole 132 (not visible in the view of the fully assembled holder 100 in FIG. 1) is formed in the end plate 102. The blind hole 132 serves as a shaft connector or female socket for receiving a male member formed in the central shaft 106. The female socket and the corresponding male member collectively form a connector for manually and releasably connecting the end plate 102 to the central shaft 106, the male member (not visible in FIG. 1) being formed in the central shaft 106. The male member is dimensioned and configured to engage the female socket by sufficient friction as to oppose unintended or spontaneous loss of engagement, but to permit release for disassembly by manual force. Obviously, relative locations of the female socket and the male member could be reversed if desired. Also, frictional engagement of the male member and the female socket may be enhanced by incorporating structure such as splines, threads, bayonet connection features, and in other ways (none shown) if desired.

The central shaft 106 has a proximal end 134 bearing the male member which engages the female socket of the first end plate 102, and a distal end 136 bearing the male member which engages the female socket of the second end plate 104. The longitudinal axis or center line 130 of the holder 100 passes through the proximal end 134 and the distal end 136 of the central shaft 106. Using the two connector features formed at the proximal end 134 and the distal end 136 of the central shaft 106, the first end plate 102, the second end plate 104, and the central shaft 106 are mutually connectable to form the assembled operative condition shown in FIG. 1.

In order to hold the golf clubs 2 in the parallel arrays depicted in FIGS. 2 and 3, the recesses 108, 110, 112, 114 are linearly aligned with corresponding recesses 116, 118, 120, 122. Linear alignment is illustrated by projection lines 138, 139 for the respective recesses 110 and 118, and 114 and 122, although obviously the remaining recesses 108, 112, 116, 120 are similarly aligned.

It should be mentioned here that additional notches or recesses (not shown) may be formed in the periphery 128 for holding articles (not shown) in addition to the golf clubs 2. Such additional recesses need not necessarily be aligned in the same way as the recesses 108, 110, 112, 114, 116, 118, 120, 122. Therefore, it may be said that at least some of the recesses which may be formed in the first plate 102, such as the recesses 108, 110, 112, 114, are linearly aligned with a corresponding number of recesses of the second plate 104, such as the recesses 116, 118, 120, 122. At least some of the possible recesses are dimensioned and configured to receive and releasably engage the shaft of the handle of a golf club 2 sufficiently tightly as to hold the golf club 2 in an orientation generally parallel to the central shaft 106, as seen in FIGS. 2 and 3.

Figure 4:
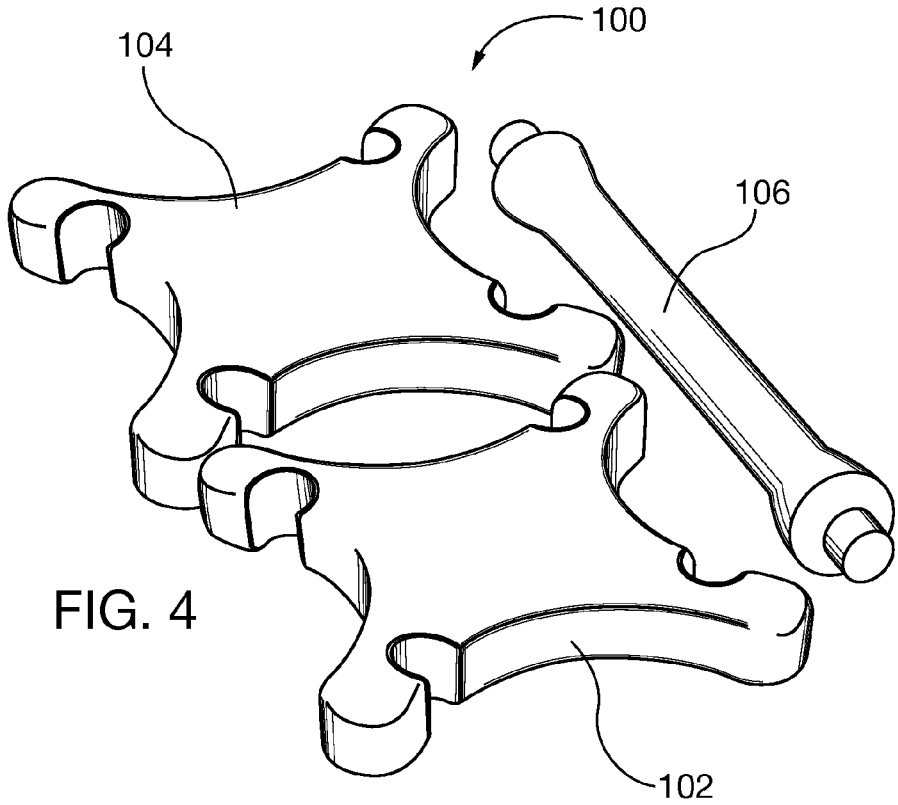
FIG. 4 is a perspective view of the components of the holder of FIG. 1, shown disassembled and placed in close proximity to one another.

FIG. 4 shows the first end plate 102, the second end plate 104, and the central shaft 106 disassembled and placed in close proximity to one another. It will be apparent from this view that the components of the holder 100 are sufficiently compact as to be storable in a conventional golf bag (not shown) for example. The holder 100 may be removed from the golf bag and utilized to organize and transport up to four clubs 2 for practice sessions for example, yet stored with the golf bag so as not to be readily separated from the golf bag and golf clubs and thereby lost or misplaced.

It will be apparent from examining FIGS. 1 and 4 that the first end plate 102 and the second end plate 104 have identical peripheral configuration when the holder is viewed from the end.

Figure 5:
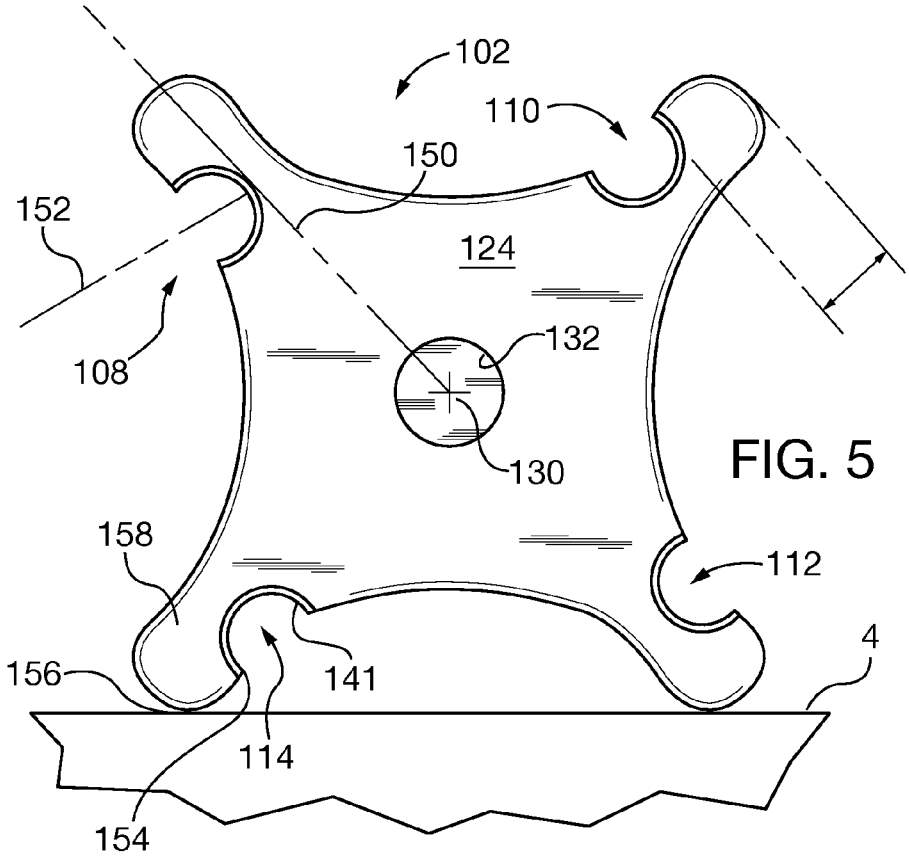
FIG. 5 shows in plan view a component seen at the left of FIG. 1.

FIG. 5 shows the first end plate 102 in direct plan view. It may be seen in FIG. 5 that those recesses for holding golf clubs, such as the recesses 108, 110, 112, 114 comprise resilient constituent material disposed to contact and grip the shaft of golf clubs such as the golf clubs 2 which are placed therein. The resilient constituent material may take the form of separate components added to the constituent material of the end plate 102, such as the liner 141, called out for the recess 114, but also provided for the recesses 108, 110, 112. This approach may be used where the structural constituent material of the end plate 102 is a hard, rigid material. Alternatively, the structural constituent material of the end plate 102 may be entirely of a substance which is sufficiently resilient, rubbery, or soft so as to oppose marring of finished metallic surfaces of shafts of handles of golf clubs retained by the holder 100.

As clearly seen in FIG. 5, the first end plate 102 has four similarly configured perimetric sides 142, 144, 146, 148 and sufficient recesses 108, 110, 112, 114 to receive and retain four golf clubs such as the golf clubs 2.

The first end plate 102 is configured such that loss of a shaft of a handle of a golf club which has been placed in a recess such as the recess 108 in a direction which is radial with respect to the center line 130 of the central shaft 106 is opposed by interference by a portion of the first end plate 102. In FIG. 5, the direction which is radial with respect to the center line 130 is shown as a projection line 150. Because the shaft of a golf club is inserted into and withdrawn from a recess such as the recess 108 in a direction indicated by a projection line 152, misalignment between the projection line 150 and the projection line 152 assures that should the holder 100 in its assembled operative condition be shaken or otherwise subjected to impacts and the like, it will not be possible for a shaft of a golf club to readily escape from the grip of its associated recess such as the recess 108. This arrangement will be referred to in terms of the affected recess comprising an opening which is disposed out of alignment with a line (i.e., the projection line 150) disposed radially with respect to and passing through the center line (e.g., the center line 130 of the central shaft 106) and extending through the center of each respective recess when the holder is in the assembled operative condition.

Of course, in the assembled operative condition of FIG. 1, with both the first end plate 102 and the second end plate 104 being aligned as shown, the same engagement of the shaft of the golf club occurs at the second end plate 104 as well as at the first end plate 102.

Another feature clearly seen in FIG. 5 is that the holder 100 may be configured such that when placed against a flat environmental surface, such as a table top, a building floor, or building wall, the holder 100 will make contact with the flat environmental surface such that the holder 100 and any golf clubs such as the golf clubs 2 being held by the holder 100 will remain stable when placed against the flat environmental surface. In addition, the golf clubs such as the golf clubs 2 being held by the holder 100 will be received and retained thereon out of contact with the flat environmental surface 4. This occurs because those portions of the end plate 102 configured to bear recesses such as the recess 114 are also arranged to extend beyond the recesses from the center line 130 to an extent greater than the distance from the center line 130 to the most distant point 154 of the recess 114. Notably, the point 156 of what may be called a leg 158 of the end plate 102 is at a greater radius from the center line 130 than is the point 154 of the recess 114. It is the point 156 of the leg 158 that makes contact with the flat environmental surface 4. A shaft of a golf club held within the recess 114 will be spaced apart from the flat environmental surface 4.

Alternatively stated, a portion (i.e., that portion of the leg 158) of the end plate 102 extends radially from the center line 130 beyond the shaft of a handle of a golf club being held by the holder 100. Of course, the same applies to the second end plate 104, so that the golf club is spaced apart from the flat environmental surface 4 along the entire length of the golf club. This may necessitate turning the head of the golf club inwardly or otherwise away from the flat environmental surface 4, as seen in FIG. 2.

A further aspect of the end plate 102 is illustrated in FIG. 5. Namely, the recesses 108, 110, 112, 114 are arranged at equal angular intervals about the center line 130, which center line 130 is of course also the longitudinal axis of the central shaft 106.

Returning to FIG. 1, when the holder 100 is in the assembled operative condition, the overall length, seen as an arrow 160, and which extends in a direction parallel to the center line or longitudinal axis 130, may be in a range of six to twenty inches. Most preferably, the length 160 is in the range of ten to eleven inches. The width, seen as an arrow 162, may be in a range of four to seven inches, and most preferably of about five inches. The thickness of the first end plate 102 may be less than three inches, for example being one or two inches, where the thickness extends in the same direction as the center line 130. These dimensions not only enable golf clubs such as the golf clubs 2 to be arrayed as seen in FIGS. 2 and 3, but also to enable a user to reach past the golf clubs, to grasp the central shaft 106, and to use the central shaft 106 as a handle to carry about a plurality of golf clubs held by the holder 100. The external surface of the central shaft 106 may be contoured to promote manual grasp when using the central shaft 106 as a handle. For example, shallow circumferential grooves 166 corresponding to the fingers of a person's hand may be formed in the central shaft 106 in well known fashion. As an alternative, the central shaft 106 may have one or more bulges disposed periodically along its length to cooperate with the palm of the user. As a further alternative, the central shaft 106 may be coated or provided with texturing, material imparting improved friction for grasping, or may be otherwise treated to enhance manual grasp.

The internally facing surface 124, the opposed externally facing surface 126, and the periphery 128 of the first end plate 102 may bear indicia such as the indicia 164 seen in FIG. 1. Of course, the second end plate 104 may also bear indicia in these locations, Indicia may be placed on the central shaft 130 if desired.

Although the invention has been described in terms of certain components being referred to in either the singular or the plural, other arrangements are possible. For example, it is to be understood that due to the conceptual description presented herein, components presented in the singular may be provided in the plural. Also, mentions of components using terms such as "at least one" or "at least some" explicitly contemplates only the specific components shown and described, and also additional such components regardless of whether explicitly shown and described.

The present invention is susceptible to modifications and variations which may be introduced thereto without departing from the inventive concepts. For example, the two end plates and central shaft could be replaced by a single member having similar functional characteristics for engaging golf clubs, the single member being sufficiently long as to hold the golf clubs effectively. If this aspect of the invention is practiced, the resulting holder (not shown) would still share certain characteristics with the holder 100. The resulting holder would comprise a member having a periphery, a center line, and a plurality of recesses formed in the periphery and spaced angularly from one another about the center line, wherein at least some of the recesses are dimensioned and configured to receive and releasably engage the shaft of the handle of a golf club sufficiently tightly as to hold the golf club in an orientation generally parallel to the center line, as seen in the holder 100. The overall length and width may be similar to those of the holder 100. The resulting holder may have a plurality of similarly configured perimetric sides, such as four perimetric sides, and sufficient recesses to receive and retain four golf clubs, as seen in the holder 100. Each one of the recesses may comprise an opening which is disposed out of alignment with a line disposed radially with respect to and passing through the center line of the holder and extending through the center of each respective recess, as occurs in the holder 100. The resulting holder may share all other characteristics of the holder 100 where such characteristics are not dependent upon the three part modular construction of the holder 100.

While such an arrangement is possible, it is preferred to provide the modular, three part construction detailed herein for the purposes of conserving constituent material, and for providing a device which when disassembled is sufficiently compact as to be storable inside a standard golf club bag without posing undue space constraints on the available storage capacity of the golf club bag.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

I claim:

1. A holder for supporting a plurality of golf clubs in a parallel array, comprising:

a first end plate having a periphery, a center, a plurality of recesses formed in the periphery and spaced angularly about the center, and a shaft connector located at the center;

a second end plate having a periphery, a center, a plurality of recesses formed in the periphery and spaced angularly about the center, and a shaft connector located at the center;

a central shaft having a proximal end, a distal end, and a longitudinal axis passing through the proximal end and the distal end, a first connector located at the proximal end which said first connector is manually connectable to and releasable from the shaft connector of the first end plate, and a second connector located at the distal end which said second connector is manually connectable to and releasable from the shaft connector of the second end plate, wherein the first end plate, the second end plate, and the central shaft are mutually connectable to form an assembled operative condition when the first end plate is assembled to the central shaft by the first connector, and the second end plate is also assembled to the central shaft by the second connector, at least some of the recesses of the first plate are linearly aligned with a corresponding number of recesses of the second plate, and at least some of the aligned recesses are dimensioned and configured to receive and releasably engage the shaft of the handle of a golf club sufficiently tightly as to hold the golf club in an orientation generally parallel to the central shaft; the periphery of the first end plate is configured to define the plurality of recesses formed in the periphery such that each one of all the recesses of the holder designed to receive the shaft of the handle of the golf club comprises an opening which is disposed out of alignment with a line disposed radially with respect to and passing through the center line of the central shaft and extending through the center of each respective recess when the holder is in the assembled operative condition; and the periphery of the second end plate is configured to define the plurality of recesses formed in the periphery such that each one of all the recesses of the holder designed to receive the shaft of the handle of the golf club comprises an opening which is disposed out of alignment with a line disposed radially with respect to and passing through the center line of the central shaft and the center of each respective recess when the holder is in the assembled operative condition, whereby loss of a shaft of a handle of a golf club in a direction which is radial with respect to the center line of the central shaft is opposed by interference by a portion of the first end plate and by a portion of the second end plate.

2. The holder of claim 1, wherein the first connector comprises a male member formed as part of one of the first end plate and the central shaft, and a female socket formed as part of the other one of the first end plate and the central shaft, and wherein the male member releasably engages the female socket by friction.

3. The holder of claim 1, wherein when in the assembled operative condition, the overall length of the holder is in the range of six to twenty inches, the first end plate has a length in the range of four to seven inches, a width in the range of four to seven inches, and a thickness less than three inches, and wherein the thickness of the first end plate extends in the same direction as the length of the central shaft;

the second end plate has a length in the range of four to seven inches, a width in the range of four to seven inches, and a thickness less than three inches, and wherein the thickness of the second end plate extends in the same direction as the length of the central shaft, whereby sufficient room is provided when a plurality of golf clubs are held by the holder to enable a user to reach past the golf clubs, to grasp the central shaft, and to use the central shaft as a handle.

4. The holder of claim 1, wherein when in the assembled operative condition, the overall length of the holder is in the range of ten to eleven inches, the first end plate has a length of about five inches, a width of about five inches, and a thickness less than two inches, and wherein the thickness of the first end plate extends in the same direction as the length of the central shaft;

the second end plate has a length of about five inches, a width of about five inches, and a thickness less than two inches, and wherein the thickness of the second end plate extends in the same direction as the length of the central shaft.

5. The holder of claim 1, wherein the first end plate and the second end plate have identical peripheral configuration when the holder is viewed from the end.

6. The holder of claim 1, wherein at least some of the recesses of the first end plate and at least some of the recesses of the second endplate comprise resilient constituent material disposed to contact and grip the shaft of golf clubs placed therein.

7. The holder of claim 1, wherein the first end plate has four similarly configured perimetric sides and has sufficient recesses to receive and retain four golf clubs, and the second end plate has four similarly configured perimetric sides and has sufficient recesses to receive and retain four golf clubs.

8. The holder of claim 1, wherein the periphery of the first end plate is arranged such that a portion of the first end plate extends radially from the center line of the central shaft beyond the shaft of a handle of a golf club being held by the holder, and the periphery of the second end plate is arranged such that a portion of the second end plate extends radially from the center line of the central shaft beyond the shaft of a handle of a golf club being held by the holder, whereby the holder may be placed against a flat environmental surface and will make contact with the flat environmental surface such that the holder and any golf clubs being held by the holder will remain stable when placed against the flat environmental surface and the golf clubs being held by the holder will be received and retained thereon out of contact with the flat environmental surface.

9. The holder of claim 1, wherein the external surface of the central shaft is contoured to promote manual grasp.

10. The holder of claim 1, wherein at least some of the recesses comprise a soft surface disposed to contact and grip the shaft of a handle of a golf club which has been received and retained by the recesses, whereby marring of finished metallic surfaces of shafts of handles of golf clubs is opposed.

11. The holder of claim 1, wherein recesses for receiving and retaining golf clubs are arranged at equal angular intervals about the longitudinal axis of the central shaft.

12. The holder of claim 1, wherein at least one of the first end plate and the second end plate comprises an externally facing surface bearing indicia.

13. A holder for supporting a plurality of golf clubs in a parallel array, comprising a member having a periphery, a center line, and a plurality of recesses formed in the periphery and spaced angularly from one another about the center line, wherein at least some of the recesses are dimensioned and configured to receive and releasably engage the shaft of the handle of a golf club sufficiently tightly as to hold the golf club in an orientation generally parallel to the center line, wherein the overall length of the holder is in the range of six to twenty inches, the holder has a width in the range of four to six inches, the holder has a plurality of similarly configured perimetric sides and has sufficient recesses to receive and retain four golf clubs, and each one of all the recesses of the holder designed to receive the shaft of the handle of the golf club comprises an opening which is disposed out of alignment with a line disposed radially with respect to and passing through the center line of the holder and extending through the center of each respective recess, whereby loss of a shaft of a handle of a golf club in a direction which is radial with respect to the center line of the holder is opposed by interference by a portion of the holder.

14. The holder of claim 13, wherein at least some of the recesses comprise resilient constituent material disposed to contact and grip the shaft of golf clubs placed therein.

15. The holder of claim 13, wherein the holder has four similarly configured perimetric sides and has sufficient recesses to receive and retain four golf clubs.

16. The holder of claim 13, wherein the holder has a periphery which is arranged such that a portion of the holder extends radially from the center line of the holder shaft beyond the shaft of a handle of a golf club being held by the holder, whereby the holder may be placed against a flat environmental surface and will make contact with the flat environmental surface such that the holder and any golf clubs being held by the holder will remain stable when placed against the flat environmental surface and the golf clubs being held by the holder will be received and retained thereon out of contact with the flat environmental surface.

17. The holder of claim 13, wherein at least some of the recesses comprise a soft surface disposed to contact and grip the shaft of a handle of a golf club which has been received and retained by the recesses, whereby marring of finished metallic surfaces of shafts of handles of golf clubs is opposed.

18. The holder of claim 13, wherein recesses for receiving and retaining golf clubs are arranged at equal angular intervals about the longitudinal axis of the holder.

19. The holder of claim 13, wherein the holder comprises a peripheral surface, a first end surface, and an opposed second end surface, and at least one of the peripheral surface, the first end surface, and the second end surfaces bears indicia.

* * * * *